United States Patent [19]

Plambeck et al.

[11] Patent Number: 4,869,699

[45] Date of Patent: Sep. 26, 1989

[54] FLYING DISK WITH CENTRIFUGALLY ACTIVATED SOUND GENERATOR

[75] Inventors: Eric P. Plambeck, Carpinteria; Thomas A. Walker, Ojai; Randall W. Karr, Santa Barbara, all of Calif.

[73] Assignee: Millennia Design, Inc., Carpinteria, Calif.

[21] Appl. No.: 302,377

[22] Filed: Jan. 27, 1989

[51] Int. Cl.[4] ..... A63H 33/26

[52] U.S. Cl. ..... 446/47; 446/46

[58] Field of Search ..... 446/46, 47, 48, 397; 273/424, 425

[56] References Cited

U.S. PATENT DOCUMENTS

| | | | |
|---|---|---|---|
| 3,720,018 | 3/1973 | Peterson et al. | 446/47 |
| 3,948,523 | 4/1976 | Michael | 446/47 X |
| 4,080,753 | 5/1978 | Hiner et al. | 446/47 |
| 4,435,917 | 3/1984 | Lee | 446/47 |

*Primary Examiner*—Robert A. Hafer
*Assistant Examiner*—Sam Rimell
*Attorney, Agent, or Firm*—Krass & Young

[57] ABSTRACT

A flying disk toy comprising a substantially planar disk configured to rotate about a central axis in sustained flight and a centrifugally activated sound generator associated with the disk is disclosed. The disk includes a cylindrical wall perpendicularly projecting from the plane of the disk and which is centrally disposed on the disk relative to its central axis. The centrifugally activated sound generator comprises two diametrically opposed centrifugal switches in series connection, each comprising a radially extending, axially inclined ramp, a pair of electrical contacts symmetrically disposed on opposite sides of the ramp in spaced apart relationship and an electrically conductive weight movably supported on the ramp. The weight has a diameter greater than the minimum spacing of the electrical contacts and centrifugal force resulting from the rotation of the disk in flight causes the weight to displace into both electrical contacts, thereby establishing an electrical closed circuit and energizing the sound generator.

12 Claims, 2 Drawing Sheets

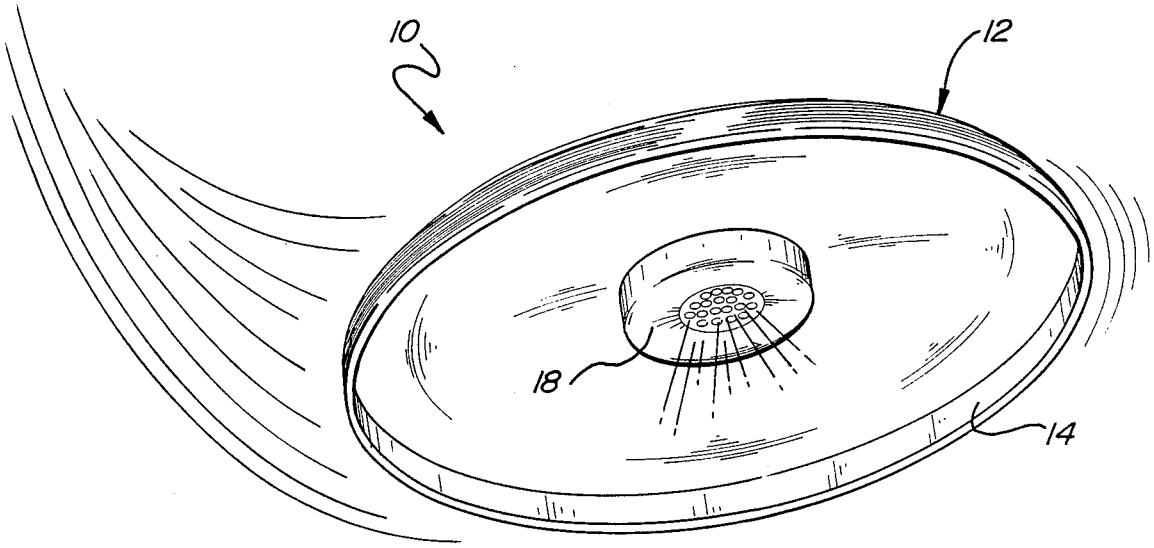
FIG. 1
FIG. 4
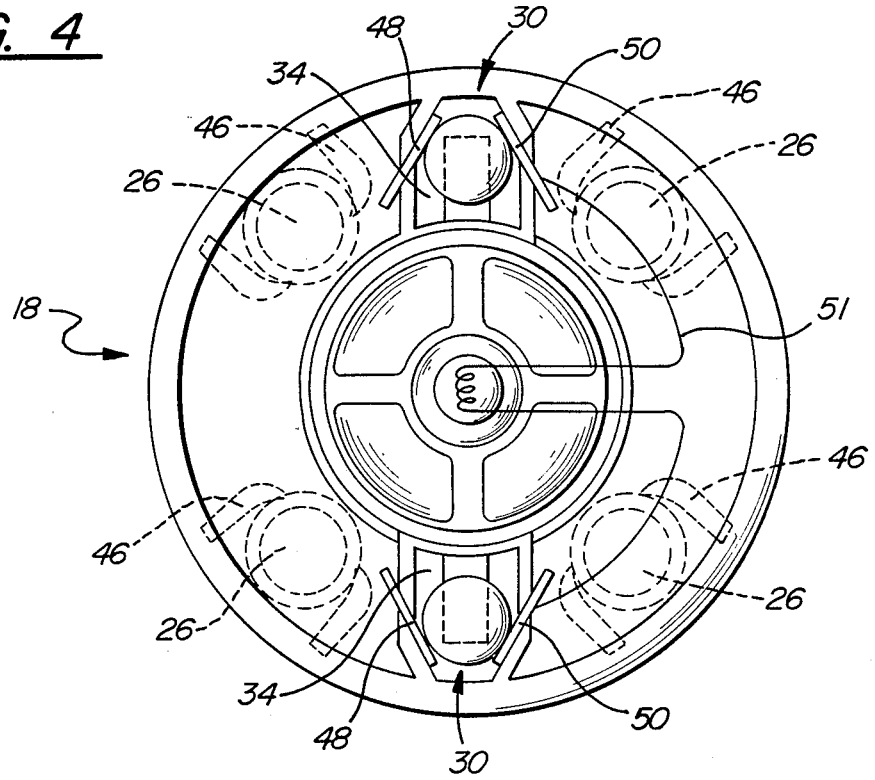

FLYING DISK WITH CENTRIFUGALLY ACTIVATED SOUND GENERATOR

FIELD OF THE INVENTION

The present invention relates to a flying disk toy and more particularly to such a toy having a centrifugally activated, electrically energized signal generator.

BACKGROUND OF THE INVENTION

Flying disk toys, most commonly known and referred to by the registered trademark, "Frisbee", owned by the Wham-O Manufacturing Company of California, have enjoyed great commercial popularity throughout the years. Flying disks, or "Frisbees", have been used as recreational toys, in contests, and in competitive sports. Many different sizes, shapes, colors and designs have been employed in making flying disk toys.

Flying disk toys have also been proposed which generate either light or sound or both while the toy is in flight. A variety of different designs have been proposed to generate either signal from the flying disk. For example, U.S. Pat. No. 2,011,813 to Heekin, discloses a flying disk toy with sound-producing members affixed to the outer periphery of the disk. The sound-producing members include vibrating wind reeds similar to those used in mouth harmonicas, which produce sound by the wind resistance produced during the flight of the toy. Funnel-shaped structures affixed to the reeds direct streams of air through the reeds during the flight of the toy. Heekin also discloses a flying disk with an illuminating device wherein a battery is connected to a small light bulb. The electrical connection between the light bulb and the battery is manually switched on before the disk is thrown and remains on continuously until manually switched off.

Centrifugally actuated light and noise generators have also been employed on flying disks to activate the desired signals while the flying disk is rotating during flight. U.S. Pat. No. 4,145,839 to Sampietro discloses a flying disk wherein centrifugal force caused by the rotation of the disk in flight forces the battery of the signal generator to contact a light bulb, thereby completing the electrical circuit.

U.S. Pat. No. 3,798,834 to Samuel discloses a disk-shaped directional toy having a centrifugal switch in connection with an audio or visual signaling device. The centrifugal switch has a weak, spring-biased switch arm which is forced outwardly by centrifugal force to engage the signaling device, thereby closing the electrical circuit between the signaling device and the power source.

U.S. Pat. Nos. 3,935,669 and 4,043,076 both to Potrzuski et al. disclose objects which generate audio or visual signals only while rotating as the result of the closure of four centrifugal switches. Potrzuski discloses three kinds of centrifugal switches: a mercury switch, a rolling ball switch, and a sliding element switch. With respect to the latter two disclosed switches, Potrzuski teaches that moving conductive elements contact the electrical contacts of the centrifugal switch only when the toy is rotated about a central axis. This contact permits electric current to flow between the contacts and the audio or visual device. However, Potrzuski's switches are mounted directly on the periphery of the toy and often interfere with its operation. Since the centrifugal switches are attached to the bottom of the disk, gripping and throwing the disk are difficult for the user. Also, due to the complexity of the electrical connection involved with Potrzuski's switches, the toy is limited to only the audio or visual signaling device with which it is manufactured. Replacement of the audio or visual signaling device is difficult employing this type of embodiment.

SUMMARY OF THE INVENTION

It will thus be appreciated that there is a need for a flying disk toy which generates an audio or visual signal only while in rotational flight which is easy to fabricate and which does not interfere with throwing or flight of the toy. The present invention addresses these problems by providing a flying disk having a centrifugally activated audio or visual signaling device affixable to the disk. In this manner, the centrifugal switches of the signaling device do not interfere with the throwing or the flight of the flying disk since they are contained within the center portion.

The present invention relates to a flying disk toy comprising a substantially planar disk configured to rotate about a central axis in sustained flight. The disk includes a cylindrical wall projecting perpendicularly from the plane of the disk. The wall is centrally disposed on the disk relative to the central axis and has a diameter less than the diameter of the disk. The flying disk toy also comprises a centrifugally activated sound generator disposed within the cylindrical wall. The centrifugally activated sound generator employs two diametrically opposed centrifugal switches, each switch comprising a radially extending ramp inclined relative to the plane of the disk so that the radially outer end of the ramp is separated from the plane of the disk by a distance greater than is the radially inner end of the ramp. The switches further comprise a pair of planar electrical contacts extending normally to the plane of the disk and symetrically disposed on opposite sides of the ramp at inclined angles relative to a radial line so that the distance between the radially outer ends of the contacts is smaller than the distance between the radially inner ends of the contacts. An electrically conductive weight, preferably in the form of a ball, is movably supported on the ramp. The ball has a diameter greater than the minimum spacing of the electrical contacts so that centrifugal force resulting from the rotation of the disk in flight causes the ball to displace radially outwardly into the electrical contacts, thereby establishing an electrical closed circuit between the contacts.

The centrifugally activated sound generator also comprises an electrical power source, preferably a battery, an electrically energized signal generator such as a Piezoelectric transducer and electrical circuitry interconnecting the power source, the signal generator and the two centrifugal switches in a series circuit.

These and other advantages of the present invention will be readily apparent from the drawings, discussion, description and claims which follow.

BRIEF DESCRIPTION OF THE DRAWINGS

FIG. 1 is a perspective view of a flying disk toy constituting a preferred embodiment of the present invention;

FIG. 4 is a top plan view of the sound generator of FIG. 1.

DETAILED DESCRIPTION OF THE PREFERRED EMBODIMENT

Figure 2:
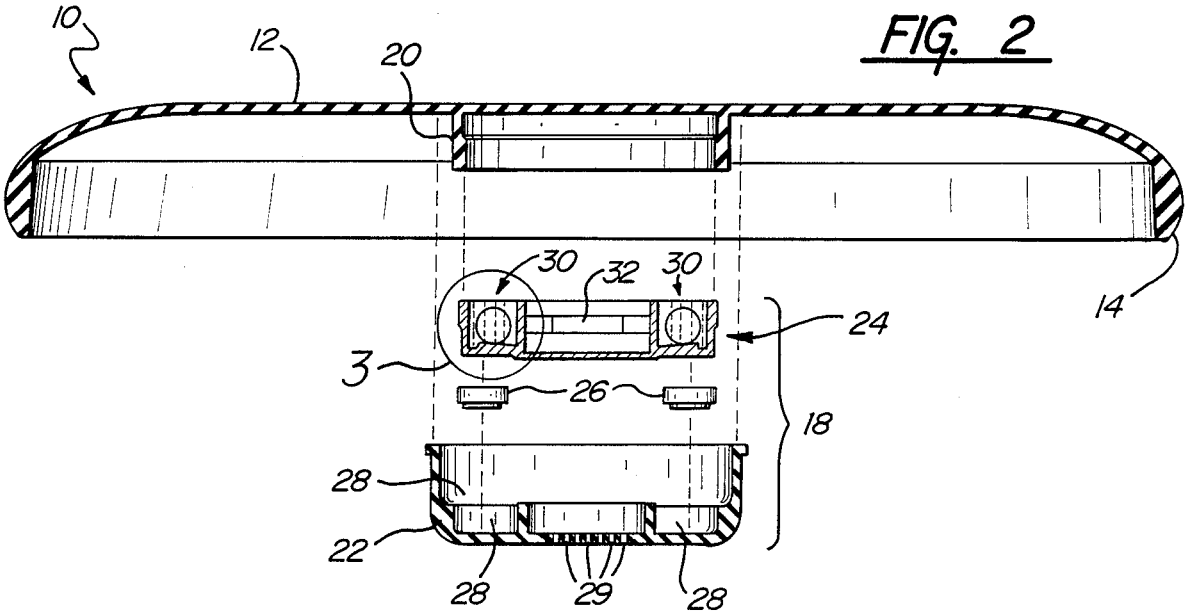
FIG. 2 is a cross-sectional, exploded view of the flying disk toy of FIG. 1.

Referring to the drawings, FIG. 1 is a perspective view of a flying disk toy 10 in sustained flight rotating about a central axis. Flying disk toy 10 comprises a substantially planar disk 12, having a downturned edge 14 and a centrifugally activated, electrically energized sound generator 18. The disk may be fabricated from a variety of materials, most preferably from synthetic polymeric materials such as polyethylene and polypropylene through an injection molding process. Flying disk toy 10 can be fabricated in a multitude of different colors, and in a variety of sizes ranging from approximately four inches in diameter to twelve inches or greater in diameter.

Referring now to FIG. 2, there is shown a cross-sectional, exploded view of the flying disk toy 10 of FIG. 1. Disk 12 further includes a cylindrical wall 20 projecting perpendicularly from the plane of the disk 12. Wall 20 is centrally disposed on the disk 12 relative to a central axis, and has a diameter substantially less than the diameter of the disk 12. The wall 20 receives the centrifugally activated sound generator 18 therein. In the preferred embodiment, wall 20 is integrally molded to the bottom surface 13 of disk 12.

Centrifugally activated sound generator 18 comprises a cylindrical, disk-shaped housing 22 securing batteries 26 and an electrically energized signal generator 24. Housing 22 is preferably fabricated by an injection molding process using synthetic polymeric materials such as polyethylene or polypropylene. Housing 22 defines chambers 28 for receiving battery 26 and signal generator 24 therein. Housing 22 further includes a plurality of openings 29 for emitting sound therethrough. Alternatively, housing 22 may be fabricated from a transparent material or contain a transparent "window" if a light emitting source is utilized as a signal generator. In the preferred embodiment, housing 22 is snap-fit over wall 20 of the disk 12. Alternatively, housing 22 can be fabricated with threaded ends so that housing 22 may be screwed over matingly engageable screw threads formed on wall 20. Various other methods of fastening may be employed, provided housing 22 is attached to wall 20 of disk 12 so that it does not loosen while the disk toy 10 is rotating in flight. Housing 22 is removable so as to facilitate the replacement of batteries 26 or signal generator 24 in case of failure of either. In the preferred embodiment, batteries 26 are a typical 1.5 volt watch type battery, however various other types and voltage size batteries can be used.

Centrifugally activated sound generator 18 further comprises two diametrically opposed centrifugal switches 30, as well as a signal generator 24. Signal generator 24 further includes a sound emitting member 32. The sound emitting member 32 may be any of a conventional type of sound emitters, such as piezoelectric transducers, buzzers, electrical bells or standard speaker assemblies activated upon receiving an electrically signal through centrifugal switches 30.

Figure 3:
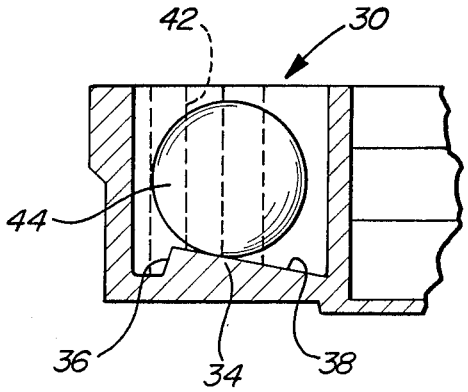
FIG. 3 is an enlarged view of a portion of the flying disk toy as shown in FIG. 2.

Referring now to FIG. 3, there is shown an enlarged view of one centrifugal switch 30 of centrifugally activated sound generator 18 of flying disk toy 10. Each centrifugal switch 30 comprises a radially extending ramp 34 inclined relative to the plane of disk 12 so that the radially outer end 36 of ramp 34 is separated from the plane of the disk by a greater distance than is the radially inner end 38 of the ramp. In the preferred embodiment, ramp 34 is inclined at a 5 degree angle with respect to the plane of the disk but other angles may be utilized as well. However, the centrifugal force needed to activate the signal generator increases as the degree of inclination of ramp 34 increases. Ramp 34 may be formed from an electrically insulating material such as a synthetic polymeric material.

Each centrifugal switch 30 further comprises a pair of electrical contacts 42 (shown in FIG. 3 in phantom outline), extending generally perpendicularly to the plane of the disk. The contacts 42 are symmetrically disposed on opposite sides of ramp 34 at inclined angles relative to a radial line so that the distance between the radially outer ends of the contacts 42 is smaller than the distance between the radially inner ends of the contacts (as shown in FIG. 4). The electrical contacts 42 may be formed from any conductive material.

Each centrifugal switch 30 further includes a ball movably supported on ramp 34. The diameter of the ball 44 is greater than the distance between the radially outer ends of the contacts 42 and less than the distance between the radially inner ends of the contacts. When the plane of the disk is substantially horizontal and the disk 12 is not rotating, gravity forces move the ball 44 to the radially inner end 58 of ramp 34. When disk 12 is rotated about its central axis, as in flight, centrifugal forces cause the ball 44 to move toward the radially outer end 36 of ramp 34. The ball 44 may be fabricated from any electrically conductive material.

FIG. 4 is a top plan view of centrifugally activated sound generator 18 in the on or activated position. As can be more clearly seen, centrifugally activated sound generator 18 comprises two diametrically opposed centrifugal switches 30 radially displaced from a center point of the sound generator 18. Centrifugally activated sound generator 18 further comprises battery slots 46 which hold the batteries 26 (shown in phantom outline). In the preferred embodiment, four diametrically opposed batteries 26 are contained in the centrifugally activated sound generator 18. Any number of batteries may be used; however the batteries 26 should be properly spaced in order to achieve proper balance of flying disk toy 10 in flight.

Centrifugal switches 30 each comprise a positive 48 and negative 50 electrical contact symmetrically disposed on opposite sides of ramp 34 as previously described. The switches 30 are connected in a series electrical connection with one another, the batteries and the signal generator 24 via electrical circuitry such as wire, foil or other electrical conductors, one of which is shown at 51. Alternatively, a light generator 52 may also be connected in a series electrical connection with the centrifugal switches in place of or in combination with signal generator 24. As shown in FIG. 4, the centrifugally activated sound generator 18 is activated by centrifugal force due to the rotation of the disk about its central axis. In the preferred embodiment both switches need to be closed in order to energize signal generator 24. At rest, if the disk is held at an angle relative to the plane of the disk, as for example while being carried by edge 14, only one switch will close and the signal generator will not be energized. In this manner, flying disk toy 10 and centrifugally activated sound generator only produce noise while the disk toy 10 is rotating in flight. Use of two or more switches also provides for better balance.

The noise produced by the centrifugally activated sound generator may be of various types, such as a buzz, a ringing, a spaceship-type noise or music. In an alternative embodiment, flying disk toy 10 can be supplied with a variety of different centrifugally activated sound generators, each producing a different noise so that a user can replace the sound generator whenever he wishes to obtain a new sound.

In light of the foregoing, it should be apparent that many variations are possible within the scope of the present invention. Accordingly, the foregoing drawings, discussion and description are merely meant to be illustrative of particular embodiments of the invention and not limitations upon the practice thereof. It is the following claims, including all equivalents, which define the scope of the invention.

We claim:

1. A flying disk toy comprising:

(I) a substantially planar disk configured to rotate about a central axis in sustained flight and including a cylindrical wall projecting perpendicularly to the plane of said disk, said wall having a diameter less than the diameter of the disk and being centrally disposed on said disk relative to said central axis; and (II) a centrifugally activated sound generator disposed within said cylindrical wall comprising:

(a) two diametrically opposed centrifugal switches, each switch comprising:

(i) a radially extending ramp inclined relative to the plane of the disk so that the radially outer end of said ramp is separated from the plane of the disk by a greater distance than the radially inner end of the ramp is separated from the plane of the disk;

(ii) a pair of electrical contacts extending generally perpendicularly to the plane of the disk and symmetrically disposed on opposite sides of said ramp at inclined angles relative to a radial line so that the distance between the radially outer ends of the contacts is smaller than the distance between the radially inner ends of the contacts;

(iii) an electrically conductive weight movably supported on said ramp, said weight having a width greater than the distance between the radially outer ends of said contacts and less than the distance between the radially inner ends of the contacts so that when the plane of the disk is substantially horizontal and the disk is not rotating, gravity forces move the weight to the radially inner end of the ramp and when the disk is rotated about its central axis, as in flight, the weight moves toward the radially outer end of the ramp under centrifugal forces;

(b) an electrical power source;

(c) an electrically energized signal generator; and (d) electrical circuitry interconnecting said power source, generator and centrifugal switches, whereby, when the disk is rotated about its central axis said weight is displaced radially outwardly against said contacts, closing the electrical circuit between the power source and generator to electrically energize the generator.

2. A flying disk toy as in claim 1, wherein said signal generator further comprises a piezoelectric transducer.

3. A flying disk toy as in claim 1, wherein said signal generator further comprises a speaker assembly.

4. A flying disk toy as in claim 1, wherein said electrically conductive weight is a ball.

5. A flying disk toy as in claim 1, wherein said centrifugally activated sound generator further comprises a centrifugally activated light emitting source in series electrical connection with said two switches and said power source.

6. A flying disk toy as in claim 1, wherein said disk further includes a downwardly extending rim around the periphery thereof and a top surface and a bottom surface.

7. A flying disk toy as in claim 6, wherein said cylindrical wall projects perpendicularly from the bottom surface of said disk.

8. A flying disk toy as in claim 1, wherein said centrifugally activated sound generator further comprises a substantially disk-shaped housing configured to be secured over said cylindrical wall and defining chambers therein for receiving said power source, said two centrifugal switches and said signal generator.

9. A flying disk toy as in claim 8, wherein said housing is snap-fit over said cylindrical wall.

10. A flying disk toy as in claim 1, wherein said power source further includes at least two diametrically opposed batteries.

11. A flying disk toy as in claim 1, wherein said disk has a diameter ranging from approximately 4 inches to approximately 12 inches.

12. A flying disk toy comprising:

(I) a substantially planar disk having a top surface, a bottom surface, and a downwardly extending rim around the periphery thereof, and configured to rotate about a central axis in sustained flight, said disk including a cylindrical wall projecting perpendicular to the plane of the disk from the bottom surface of said disk, said wall having a diameter less than the diameter of the disk and being centrally disposed on said disk relative to said central axis; and (II) a centrifugally activated sound generator disposed within said cylindrical wall comprising:

(a) two diametrically opposed centrifugal switches, each switch comprising:

(i) a radially extending ramp inclined relative to the plane of the disk so that the radially outer end of the ramp is separated from the plane of the disk by a greater distance than is the radially inner end of said ramp;

(ii) a pair of electrical contacts extending generally perpendicular to the plane of the disk and symmetrically disposed on opposite sides of said ramp at inclined angles relative to a radial line so that the distance between the radially outer ends of the contacts is smaller than the distance between the radially inner ends of the contacts;

(iii) an electrically conductive ball disposed on said ramp, said ball having a diameter greater than the distance between the radially outer ends of said contacts and less than the distance between the radially inner ends of the contacts so that when the plane of the disk is substantially horizontal and the disk is not rotating, gravity forces move the ball to the radially inner end of the ramp and when the disk is rotated about its central axis, as in flight, the ball moves toward the radially outer ends of the ramp under centrifugal forces;

(b) at least one battery;

(c) an electrically energized signal generator;

(d) a substantially disk-shaped housing configured so as to be secured over said cylindrical wall and defining chambers therein for receiving said at least one battery, said two centrifugal switches and said signal generator; and (e) electrical circuitry connecting said batteries, generator and centrifugal switch, whereby, when the disk is rotated about its central axis said ball is displaced radially outwardly against said contacts closing the electrical circuit between the batteries and the generator to electrically energize the generator.

* * * * *